US005585156A

United States Patent [19]

Fontana

[11] Patent Number: 5,585,156

[45] Date of Patent: Dec. 17, 1996

[54] LASER LAW TAG

[75] Inventor: Sharon M. Fontana, Northbrook, Ill.

[73] Assignee: Moore Business Forms, Inc., Grand Island, N.Y.

[21] Appl. No.: 459,912

[22] Filed: Jun. 2, 1995

Related U.S. Application Data

[62] Division of Ser. No. 268,184, Jun. 29, 1994, Pat. No. 5,533,459.

[51] Int. Cl.[6] ..... B65D 65/28; G09F 3/00

[52] U.S. Cl. ..... 428/43; 5/658; 283/81; 283/101; 283/103; 283/105; 428/192; 428/195; 428/220

[58] Field of Search ..... 5/658, 448; 2/80; 428/40, 43, 195, 40.1, 192, 220; 283/101, 103, 105, 81

[56] References Cited

U.S. PATENT DOCUMENTS 4,095,299 6/1978 Schweiso ..... 5/658
5,389,414 2/1995 Popat ..... 428/40

*Primary Examiner*—Nasser Ahmad
*Attorney, Agent, or Firm*—Nixon & Vanderhye P.C.

[57] ABSTRACT

A law tag for mattresses or other bedding is made from a substrate of laser compatible and printable uniform material stock having sufficient tear resistance to comply with requirements for a law tag on bedding, automatic sewing machine sewability, press printability, and perfability. Law tag indicia is printed on the substrate with heat resistant ink, dried, subjected to static elimination, and then perfed, cut into sheets, and sent to a customer to be laser printed. Contents indicia laser printing is applied to the substrate at the customer's facilities. The sheets are torn along the perfs, bar codes on work tabs separated from the sheets are scanned, and the law tags are sewed to mattresses.

15 Claims, 4 Drawing Sheets

LASER LAW TAG

This is a divisional of application Ser. No. 08/268,184, filed Jun. 29, 1994, now U.S. Pat. No. 5,533,459.

BACKGROUND AND SUMMARY OF THE INVENTION

Informational tags known as "law tags" are universally provided on mattresses and like bedding. A law tag is tag of material on which various contents indicia are printed as well as an indication that the tag is not to be removed, such indicia typically reading: "UNDER PENALTY OF LAW THIS TAG NOT TO BE REMOVED EXCEPT BY THE CONSUMER". Conventionally in the manufacture and application of law tags to upholstered furnishings, e.g., mattresses, couches and chairs, TYVEK tags printed by a dot matrix (impact) printer are almost universally used because of their tear resistance and sewability, both necessary requirements for a law tag. However normally such tags are part of a composition construction, typically connected to conventional card/label stock with adhesive. It is desirable to print the card/label stock with more readable print than is typically provided by dot matrix printers, e.g. to laser print the stock. However this is impractical in many situations because of damage to other indicia by the laser printer, or requires two passes of the composite material through printers. Also composite material tags are relatively expensive, there is significant waste associated therewith, perfing is sometimes less than optimum, there is less than optimum toner anchorage to the substrates, and it is difficult or tedious to print readily scannable bar codes on the substrate.

Another problem associated with conventional law tags is that they are subject to tearing or ripping either during the manufacturing/printing and subsequent attachment to the mattress, bedding or upholstered furnishings or they can be torn during shipment and set up. Moreover, law tags can also be torn off of these consumable goods while on retail display.

According to the present invention a method, business form containing a law tag, and combination of a law tag with a mattress, are provided which overcome the drawbacks discussed above. In particular, the business form according to the present invention is in single material sheet form and is readily perfable, and it has laser compatibility—yet it has sufficient tear resistance and sewability to be useful as a law tag, meeting governmental regulations with respect thereto. Using the business form according to the invention a mattress or other bedding manufacturer can obtain numerous advantages including lower cost for the tags, better readability of bar code information (such as on work tabs), lower overall cost of production of final printed tag products and at higher speed, and less waste of material.

According to one aspect of the invention, a method of constructing bedding tags using laser compatible and printable uniform material stock sheets having sufficient tear resistance to comply with requirements for a law tag on bedding, automatic sewing machine sewability, press printability, and perfability, is provided. The method comprises the following steps: (a) Imaging first indicia with heat resistant ink on the stock including law tag indicia. (b) Automatically perfing the stock to form at least first and second parts or portions separated by a first perf line, the first portion including the law tag indicia. (c) Laser printing variable indicia on each stock sheet, including composition material indicia on the first portion. (d) After steps (a)–(c) ultimately separating the first portion from the second portion along the first perf line; and then (e) sewing the first portion to upholstered furnishings, such as bedding, couches and chairs.

Step (e) is typically practiced by sewing the first portion to a mattress using an automatic sewing machine. At least one of steps (a) and (c) are practiced to image specifications or instructions for a mattress being constructed to correspond with the first portion law tag indicia. Step (b) is practiced to provide a second perf line to provide two sets of the first and second portions in a single sheet of stock, and to provide at least a third portion separated from the first or second portion by a second perf line, the third portion having a plurality of sub-portions separated by third perf lines; and wherein step (c) is practiced by bar code printing on at least some of the third portion sub-portions.

The method may also comprise the further step, substantially simultaneously with step (b), of die cutting the stock into the sheets, and step (c) is typically further practiced by printing piece-work indicia as the bar coding on the third portion sub-portions. There may also be the further steps, between steps (a) and (b), of drying the heat resistant ink indicia, and eliminating static from the stock.

According to another aspect of the present invention a business form, suitable for use in constructing law tags, is provided. The business form of the invention includes the following elements: A substrate of laser compatible and printable uniform material stock having sufficient tear resistance to comply with requirements for a law tag on bedding, automatic sewing machine sewability, press printability, and perfability. A first line of weakness separating the substrate into at least first and second portion. The first portion having law tag indicia imaged thereon, and contents indicia laser printing thereon; and the second portion having laser printed indicia thereon. Preferably a second line of weakness divides the substrate into a third portion, the third portion having laser printed bar code indicia thereon.

Typically the substrate comprises a sheet of roughly 8½ by 11 inch or 8½ by 14 inch size, and includes a third line of weakness dividing the sheet approximately in half, each half including first, second and third portions. A plurality of additional lines of weakness may be formed in the third portion, defining different work tabs, a plurality of the work tabs having bar code indicia associated therewith.

The substrate comprises 100–135# (preferably 120–125#) paper stock having one or more laser coatings thereon, such as Kimberly Clark Co. LASER S 90267. Also, the law tag indicia comprises heat resistant ink, such as a pastel from Water Ink Technologies, Inc. of Iron Station, N.C.

According to yet another aspect of the invention, there is provided in combination a mattress and a law tag, the law tag sewed to the upholstered furnishing, and the law tag comprising: a substrate of laser compatible and printable uniform material stock having sufficient tear resistance to comply with requirements for a law tag on a bedding, automatic sewing machine sewability, press printability, and perfability; law tag indicia printed on the substrate; and contents indicia laser printing also on the substrate.

It is the primary object of the present invention to provide for the advantageous yet effective manufacture of law tags, and attachment thereof to upholstered furnishings. This and other objects of the invention will become clear from an inspection of the derailed description of the invention, and from the appended claims.

DETAILED DESCRIPTION OF THE DRAWINGS

Figure 1:
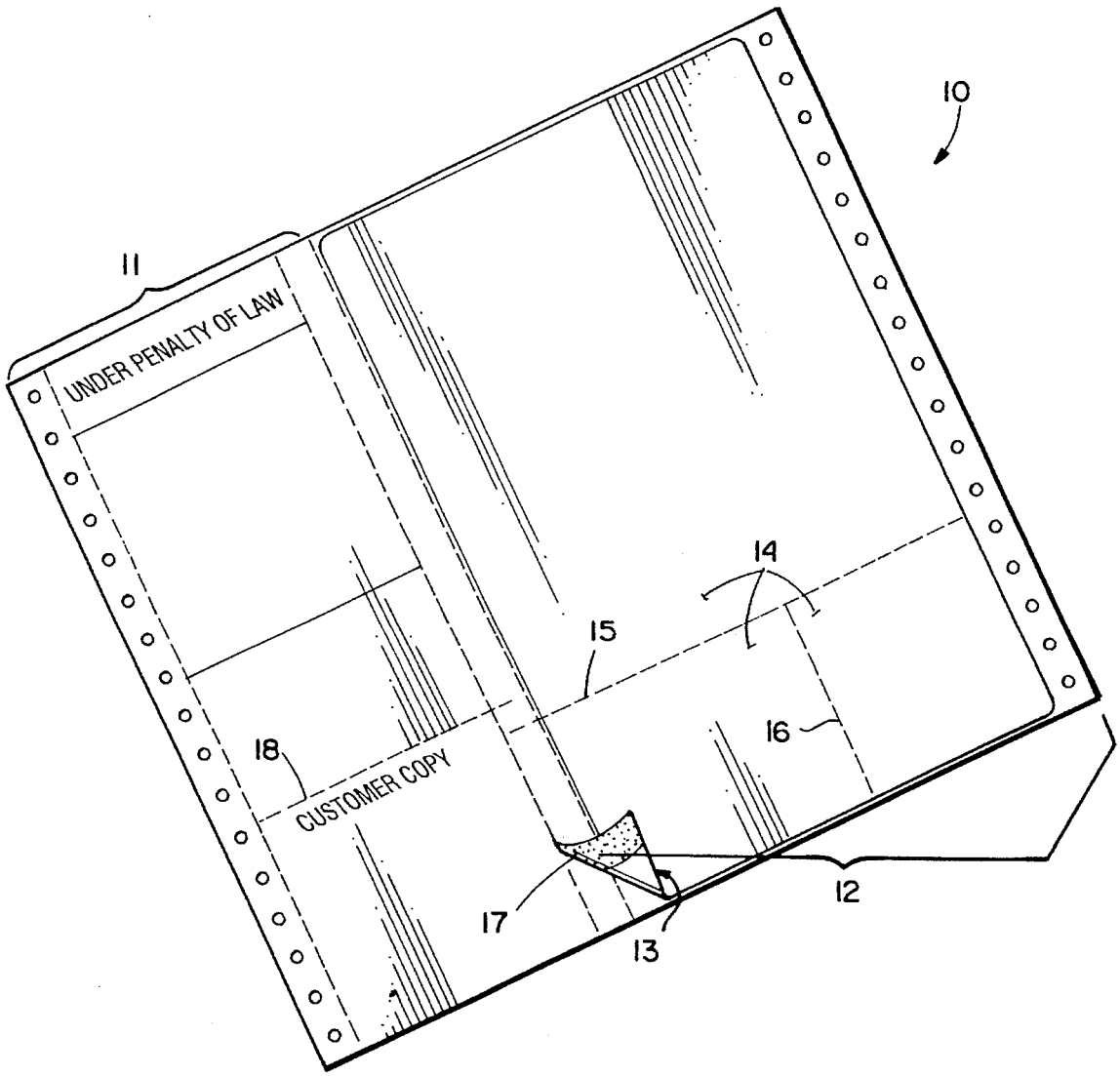
Fig. 1 (PRIOR ART)
FIG. 1 is a perspective view of a conventional prior art composite material business form used in the production of law tags.

An exemplary prior art business form over which the invention is an improvement is shown generally by reference numeral 10 in FIG. 1. It includes a law tag section 11 of TYVEK tear resistant, sewable, material, and a second section 12 of card or label stock. The edge 13 of the second section 12 is shown upturned in FIG. 1 only for clarity of illustration purposes. The section 12 includes a plurality of sections 14 defined by perf lines 15, 16. Section 12 is connected to section 11 by adhesive 17 so that the entire form 10 can move through impact (dot matrix) printers for printing contents on the law tag section 11, and for printing indicia on the second section 12. Another perf line 18 may also be provided separating the law tag section into two parts, a top part which comprises the actual law tag that must remain on a mattress, and a customer copy (the part below line 18).

While the law tag produced from the form 10 of FIG. 1 performs its function well, the form 10 is relatively expensive and difficult to handle due to the composite material nature thereof. Also printing is slow because a dot matrix printer must be used to print the portion 11 since it is not laser compatible. Also, any bar coding printed on the form 10 is not as scannable as desired since it doesn't have laser clarity.

Figure 2:
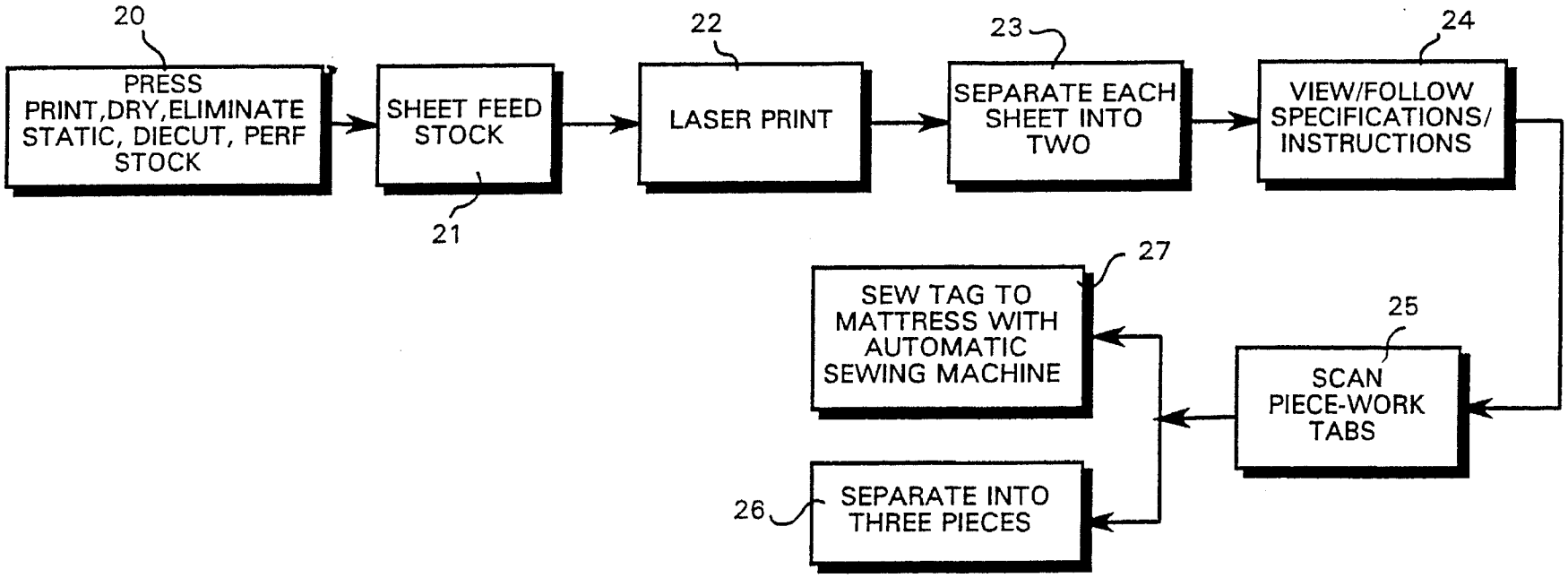
FIG. 2 is a schematic, box diagram, showing steps in the manufacture of law tags according to an exemplary method of the invention.

According to the present invention an improved business form (FIG. 3) is produced according to the method schematically illustrated in FIG. 2. The method of FIG. 2 is practiced on a substrate of laser compatible and printable uniform material stock having sufficient tear resistance to comply with requirements for a law tag on a bedding, automatic sewing machine sewability, printability, and perfability. The stock may, for example, be the proprietary product sold commercially by Kimberly Clark Co. and known as LASER S 90267. This stock typically has a weight of about 100–135 pounds per 1000 sheet ream (preferably 120–125 lbs.), and is available in a nine inch wide web. The web is typically run through a static eliminator before acting on it further.

The stock substrate is impregnated with a tear resistant saturant and coated with a toner receptive material. There are a number of saturants commercially available which would strengthen the fibers of any substrate. As for the toner receptive coating, an exemplary one is marketed under the name MooreFuse™ and is the subject of copending application Ser. No. 08/011,715. This coating actually raises the surface of the substrate to provide for better toner anchorage. That is, the surface is discontinuous, having raised and sunken portions so that the irregularities of the toner grab the coating.

The stock is press printed with the law tag information including, e.g. "UNDER PENALTY OF LAW..." at stage 20 using heat resistant ink. The heat resistant ink may be, for example, blue, yellow, pink, or other pastel (or other color) ink such as that available from Water Ink Technologies, Inc. of Iron Station, N.C., on a conventional press. After printing the web is passed through at least one, but as many as four, driers to dry the ink on the web, and is passed through a second (or only) static eliminator. The web then is typically trimmed to an 8½ inch width (each margin is trimmed) and then die cut to produce individual sheets, as also indicated in box 20 in FIG. 2. Perforations are also formed in the web using conventional perforation equipment. The individual sheets that are produced — as indicated at 21 in FIG. 2—may have 11 or 14 inch lengths depending upon the particular application. They may be collected 100 to a pack and shipped to a customer—typically a bedding (e.g. mattress) manufacturer.

The sheets from 21 are then laser print, as indicated at 22 in FIG. 2, using a conventional laser printer, variable information from the manufacturer being applied. Then the sheets are separated into two parts along a line of weakness (perforation line) as indicated at 23, and then the necessary specifications and/or instructions for further manufacture or handling which are printed on the sheet are then viewed or followed as indicated at 24. Each half sheet is then separated into three pieces as indicated at 25, along perf lines, and the work tabs that are separated out are scanned as indicated at 26 (also see FIG. 5), while the law tags are sewed to mattresses with automatic sewing machines as indicated at 27 (see FIG. 4).

Figure 3:
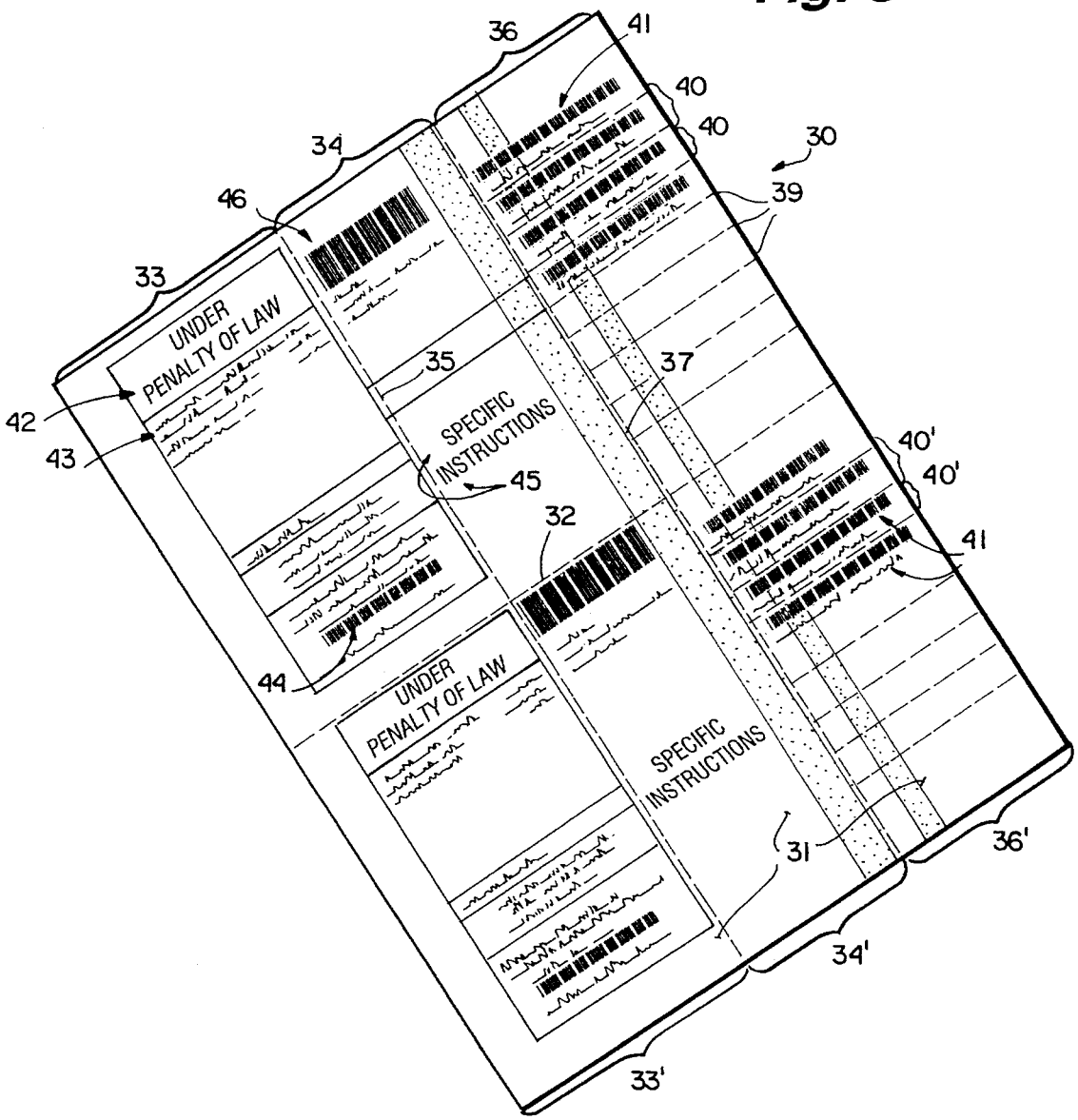
FIG. 3 is a is a view like that of FIG. 1 of a business form according to the invention.

FIG. 3 shows a business form 30 according to the present invention. It includes a substrate 31 of laser compatible and printable uniform material stock having sufficient tear resistance to comply with requirements for a law tag on a bedding, automatic sewing machine sewability, printability, and perfability. A transverse line of weakness (preferably perf line) 32 divides substrate 31 in half (e.g. an eleven inch length into 5.5 inches). It also includes three different portions 33, 34, 36 in the "top" half as viewed in FIG. 3, and 33', 34', 36' in the "bottom" half. Longitudinal lines of weakness 35, 37 divide the substrate 31 into the portions 33, 34, 36, etc.

The substrate 31 preferably is Kimberly Clark Co. LASER S 90267. This stock typically has a weight of about 100–135 pounds per 1000 sheet ream. Other materials could also be used, however, as long as they have the requirements of tear resistance, laser printability, and perfability. Normally stocks of over 135 pounds may have problems with "ghosting", while substrates less than 100 pounds may have insufficient tear resistance to comply with governmental regulations. Therefore, 120–125 pound substrates 31 are preferred. They may be coated on one or both sides with laser coat materials, such as those used commercially by Kimberly Clark Co.

The portions 36, 36' are also divided into sub portions or work tabs 40, 40' by transverse perf lines 39. Bar coding 41 is printed on at least some of the tabs 40, 40' during laser printing (step 22 in FIG. 2). The indicia 42 on the law tag part, including at least the "UNDER PENALTY OF LAW. . ." language, is printed in heat resistant ink in step 20, as earlier described, while the contents of the bedding is indicated by indicia 43 printed during laser printing step 22. Bar coding 44, generally corresponding to coding 41, is also typically printed during laser printing step 22, on portion 33, 33', as are specific instructions 45 for further manufacture or the like, and/or bar coding 46 (on portion 34, 34').

Figure 4:
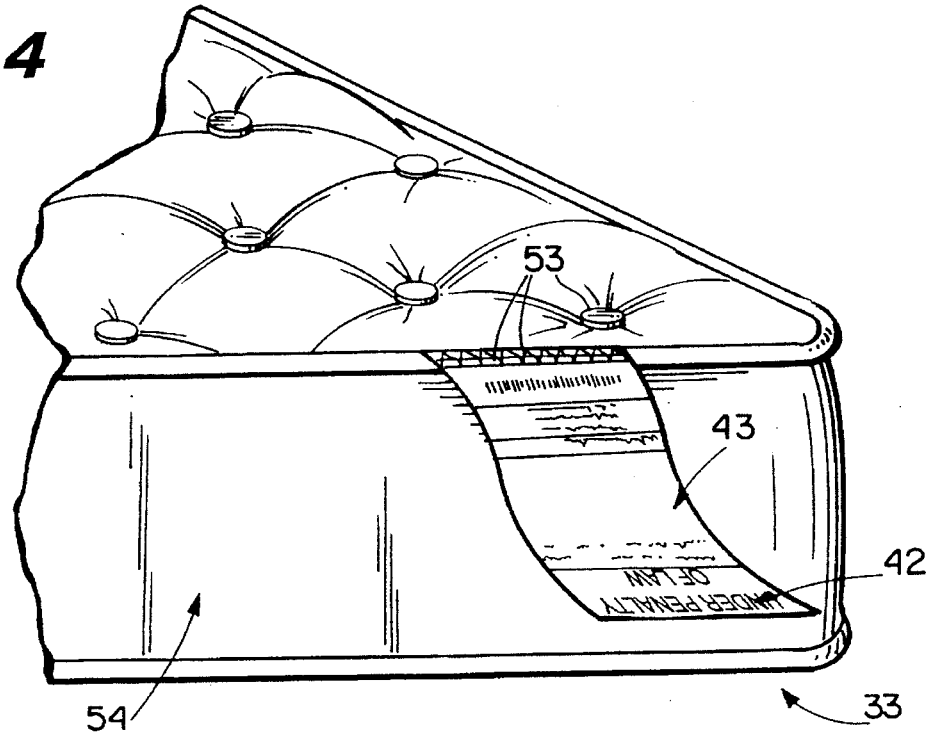
FIG. 4 is a is a perspective view showing the combination of a law tag from the business form of FIG. 3 sewed to a mattress.
Figure 5:
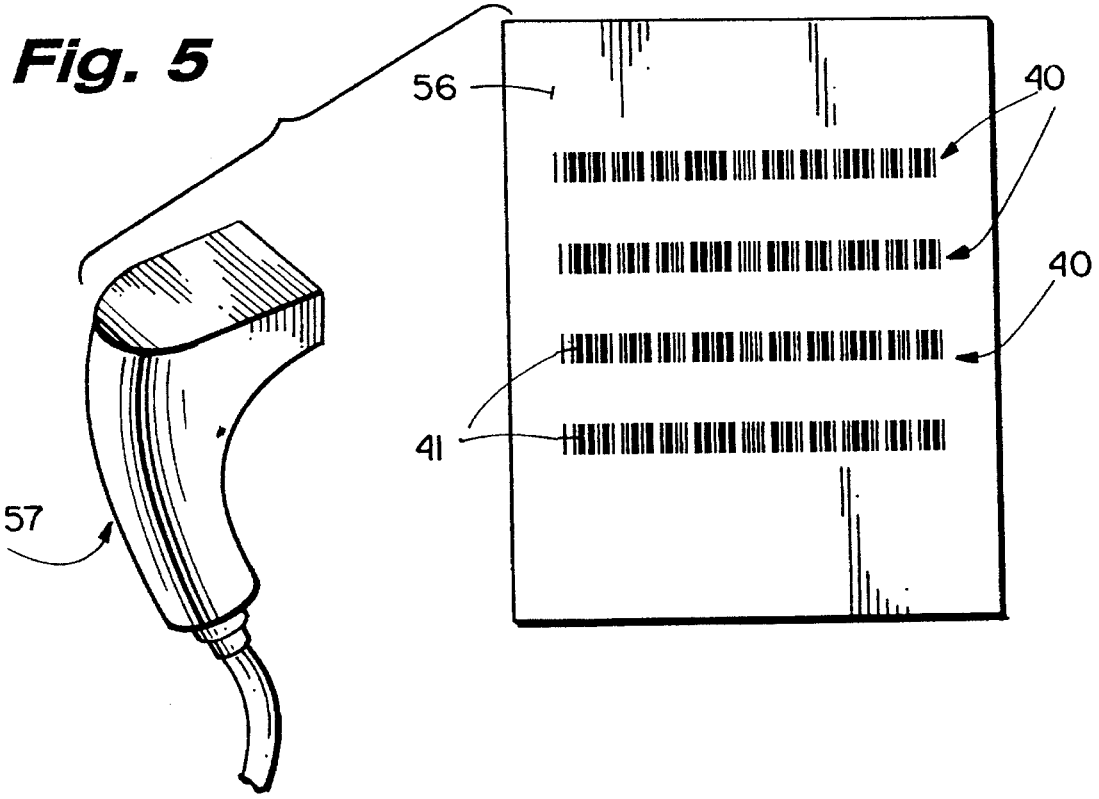
FIG. 5 is a perspective view showing work tabs from the business form of FIG. 3 placed up on a white board for scanning.

After the form 30 has been separated first along perf line 32, and then along perf lines 35, 37 the individual portions 33, 33', 34, 34', and 36, 36', are then used separately. Portions 34, 34' provide instruction for manufacture, or specifications (indicia 45), while law tags 33, 33' are attached to bedding. FIG. 4 shows a law tag 33 sewed by automatic sewing machine sewing/stitching 53 to a mattress 54.

The portions 36, 36' are used by the workers manufacturing the bedding to provide them credit for the work they do. At different stages of manufacture, workers will tear off the work tabs 40 associated with each different mattress they work on, with bar coding 41 thereon, and put them up on a white board 56, or the like (see FIG. 5). The bar coding 41 will then be read with a scanner 57, and the workers will then get credit for having worked on the mattresses they have.

It will thus be seen that according to the present invention an advantageous method, business form, and combination of mattress and law tag, are provided which are highly advantageous compared to the prior art. The forms of the invention are cheaper, easier to handle, more readable, and more quickly and easily produced into law tags and related form elements, than conventional TYVEK-card stock composite material business forms used in the prior art.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A business form comprising:

a substrate of laser compatible and printable uniform material stock having sufficient tear resistance to comply with requirements for a law tag on upholstered furnishings, automatic sewing machine sewability, press printability, and perfability;

a first line of weakness separating said substrate into at least first and second portions;

said first portion having law tag indicia imaged thereon, and also contains laser printed indicia thereon; and said second portion having laser printed indicia thereon.

2. A business form as recited in claim 1 further comprising a second line of weakness dividing said substrate into a third portion, said third portion having laser printed bar code indicia thereon.

3. A business form as recited in claim 1 wherein said substrate comprises a sheet of roughly 8½ by 11 inch or 8½ by 14 inch size, including a third line of weakness dividing said sheet approximately in half, each half including first, second and third portions.

4. A business form as recited in claim 2 further comprising a plurality of additional lines of weakness formed in said third portion, defining different tabs, each tab having a bar code indicia associated therewith.

5. A business form as recited in claim 1 wherein said substrate comprises 100–135 pounds per 1000 sheet ream paper stock having one or more laser coatings thereon.

6. A business form as recited in claim 1 wherein said law tag indicia comprises heat resistant ink.

7. A business form as recited in claim 3 further comprising a plurality of additional lines of weakness formed in said third portion, defining different tabs, each tab having a bar code indicia associated therewith.

8. A business form as recited in claim 2 wherein said law tag indicia comprises heat resistant ink.

9. A business form as recited in claim 2 wherein said substrate comprises 100–135 pounds per 1000 sheet ream paper stock having one or more laser coatings thereon.

10. A business form as recited in claim 5 wherein said law tag indicia comprises heat resistant ink.

11. A business form as recited in claim 5 wherein said substrate comprises 120–125 pounds per 1000 sheet ream paper stock treated by a static eliminator.

12. A business form as recited in claim 9 wherein said substrate comprises 120–125 pounds per 1000 sheet ream paper stock treated by a static eliminator.

13. A business form as recited in claim 1 wherein said substrate comprises 120–125 pounds per 1000 sheet ream paper stock treated by a static eliminator.

14. A business form as recited in claim 5 wherein said substrate has more than one laser coating thereon.

15. A business form as recited in claim 9 wherein said substrate has more than one laser coating thereon.

* * * * *